US007841412B2

(12) United States Patent
Jasser et al.

(10) Patent No.: US 7,841,412 B2
(45) Date of Patent: Nov. 30, 2010

(54) MULTI-PURPOSE PRESSURE OPERATED DOWNHOLE VALVE

(75) Inventors: Rami J. Jasser, Houston, TX (US); Robert D. Morton, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 88 days.

(21) Appl. No.: 11/677,479

(22) Filed: Feb. 21, 2007

(65) Prior Publication Data

US 2008/0196898 A1 Aug. 21, 2008

(51) Int. Cl.
*E21B 34/10* (2006.01)

(52) U.S. Cl. ..... 166/319

(58) Field of Classification Search ..... 166/319, 166/316, 323, 325, 332.8, 331, 321; 251/298
See application file for complete search history.

(56) References Cited

U.S. PATENT DOCUMENTS

| | | | | |
|---|---|---|---|---|
| 3,763,932 | A * | 10/1973 | Dinning | 166/72 |
| 3,783,893 | A * | 1/1974 | Davison | 137/527.8 |
| 4,105,069 | A | 8/1978 | Baker | |
| 4,216,830 | A * | 8/1980 | Fredd | 166/319 |
| 4,478,286 | A * | 10/1984 | Fineberg | 166/324 |
| 4,688,593 | A * | 8/1987 | Pringle et al. | 137/115.08 |
| 5,529,126 | A | 6/1996 | Edwards | |
| 5,826,652 | A | 10/1998 | Tapp | |
| 5,947,205 | A | 9/1999 | Shy | |
| 6,085,845 | A | 7/2000 | Patel et al. | |
| 6,119,783 | A | 9/2000 | Parker et al. | |
| 6,152,224 | A * | 11/2000 | French | 166/250.08 |
| 6,189,354 | B1 | 2/2001 | Spath | |
| 6,230,807 | B1 | 5/2001 | Patel | |
| 6,662,877 | B2 | 12/2003 | Patel | |
| 6,732,803 | B2 * | 5/2004 | Garcia et al. | 166/373 |
| 6,763,892 | B2 | 7/2004 | Kaszuba | |

(Continued)

FOREIGN PATENT DOCUMENTS

WO 03054347 A1 7/2003

(Continued)

OTHER PUBLICATIONS

Baker Hughes, Baker Oil Tools; Technical Unit Flow Control Systems—Sliding Sleeves; Unit No. TU10356; Jan. 26, 2006; pp. 1, 2, 6.

(Continued)

*Primary Examiner*—Kenneth Thompson
*Assistant Examiner*—James G Sayre
(74) *Attorney, Agent, or Firm*—Steve Rosenblatt

(57) ABSTRACT

A downhole valve features a flow port that can be selectively obstructed by a pressure actuated sleeve that is movable in a pin and slot mechanism to rotate while being cycled up and down by application and removal of pressure in a cyclical manner. When the sleeve is cycled to the port closed position, a flapper mounted near its upper end can fall on a seat on the sleeve to allow pressure to be applied to the flapper and sleeve, causing the sleeve to move to a position that will prevent fluid loss from the tubular string into the formation. The Closed flapper allows pressure cycles of the sleeve. A double closure against fluid loss can be affected.

21 Claims, 1 Drawing Sheet

U.S. PATENT DOCUMENTS

| | | | | |
|---|---|---|---|---|
| 6,810,087 | B2 | 10/2004 | Hoctor et al. | |
| 6,834,722 | B2 * | 12/2004 | Vacik et al. | 166/321 |
| 6,889,771 | B1 | 5/2005 | Leising et al. | |
| 6,948,561 | B2 | 9/2005 | Myron | |
| 7,066,264 | B2 | 6/2006 | Bissonnette et al. | |
| 7,090,020 | B2 | 8/2006 | Hill et al. | |
| 7,152,678 | B2 | 12/2006 | Turner et al. | |
| 2003/0121665 | A1 * | 7/2003 | Trott et al. | 166/332.8 |
| 2004/0118562 | A1 | 6/2004 | George | |
| 2004/0144546 | A1 | 7/2004 | Read, Jr. | |
| 2005/0236154 | A1 * | 10/2005 | Tudor et al. | 166/308.1 |
| 2006/0169465 | A1 | 8/2006 | Hejl et al. | |
| 2008/0029273 | A1 * | 2/2008 | Pia | 166/373 |

FOREIGN PATENT DOCUMENTS

| | | | |
|---|---|---|---|
| WO | 2007091055 | A1 | 8/2007 |

OTHER PUBLICATIONS

Walker, Tim, et al., "Downhole Swab Valve Aids in Underbalanced Completion of North Sea Well", SPE 30421, Sep. 1995, 541-546.
Crow, S.L., et al., "Means for Passive Inflow Control Upon Gas Breakthrough", SPE 102208, Sep. 2006, 1-6.
Almond, Ken, et al., "Improving Production Results in Monobore, Deepwater and Extended Reach Wells", SPE 77519, Oct. 2002. 1-15.

* cited by examiner

MULTI-PURPOSE PRESSURE OPERATED DOWNHOLE VALVE

FIELD OF THE INVENTION

The field of the invention is downhole valves that can provide bi-directional fluid flow, as well as to prevent fluid loss into the formation and can be opened using only surface pressure to allow production and more particularly valves that can be operated from the surface by pressure so that a surface rig is not needed to stop the possibility of production or fluid loss to the formation.

BACKGROUND OF THE INVENTION

Completions in low pressure formations involve a risk of fluid loss into the formation. In these instances the hydrostatic pressure from the liquid column in the production string is higher than the formation pressure. A fluid loss valve selectively keeps the fluid in the production string from flowing into the formation and potentially decreasing its subsequent ability to produce hydrocarbons from the formation. On the other hand, when the formation needs to be produced, the valve must be opened to allow the formation a path to the surface through the production tubing.

In the past, packer assemblies have come with valves that can be opened with production string manipulation. In some cases the manipulation involved up and down cycling to operate a downhole j-slot mechanism to change the position of a valve associated with a packer to either and open or a closed position with an exit from the j-slot being available to pull the string out of the hole. One example of such a design is U.S. Pat. No. 5,826,652. Another mechanically manipulated valve for controlling fluid loss involves a stinger on the bottom of the production string that can be engaged to a sliding sleeve valve to set it in an open or closed position with string manipulation. This product is available from Baker Oil Tools under the product name Reservoir Control Valve Product Family H68406. J-slot valves of various types are illustrated in U.S. Pat. Nos. 5,529,126; 6,889,771 and 7,090,020.

In both instances, the mechanical string manipulation that it takes to operate these valves requires the use of a rig. The cost of a rig is very high and the present invention allows the provision of a fluid loss valve that can be operational to prevent loss to the formation and can then be disabled as the formation is allowed to come into the production string. The positions can be achieved with pressure rather than tubing string manipulation. A flapper and a sliding sleeve provide a dual closure to prevent fluid loss. Pressure operation manipulates a sleeve to an open position and the formation coming in moves the flapper out of the way. These and other features of the invention will be more apparent to those skilled in the art from a review of the description of the preferred embodiment and associated drawings that appear below, while recognizing that the full scope of the invention is measured by the appended claims.

SUMMARY OF THE INVENTION

A downhole valve features a flow port that can be selectively obstructed by a pressure actuated sleeve that is movable in a pin and slot mechanism to rotate while being cycled up and down by application and removal of pressure in a cyclical manner. When the sleeve is cycled to the port closed position, a flapper mounted near its upper end can fall on a seat on the sleeve to prevent fluid in the tubular string into the formation from returning down into the formation as would be the case, for example, where an electric, mechanical or hydraulic pump above the valve had been taking fluid from the formation, and had been turned off. The closed flapper allows pressure to cycle the sleeve. A double closure against fluid loss can be affected.

DETAILED DESCRIPTION OF THE PREFERRED EMBODIMENT

Figure 1:
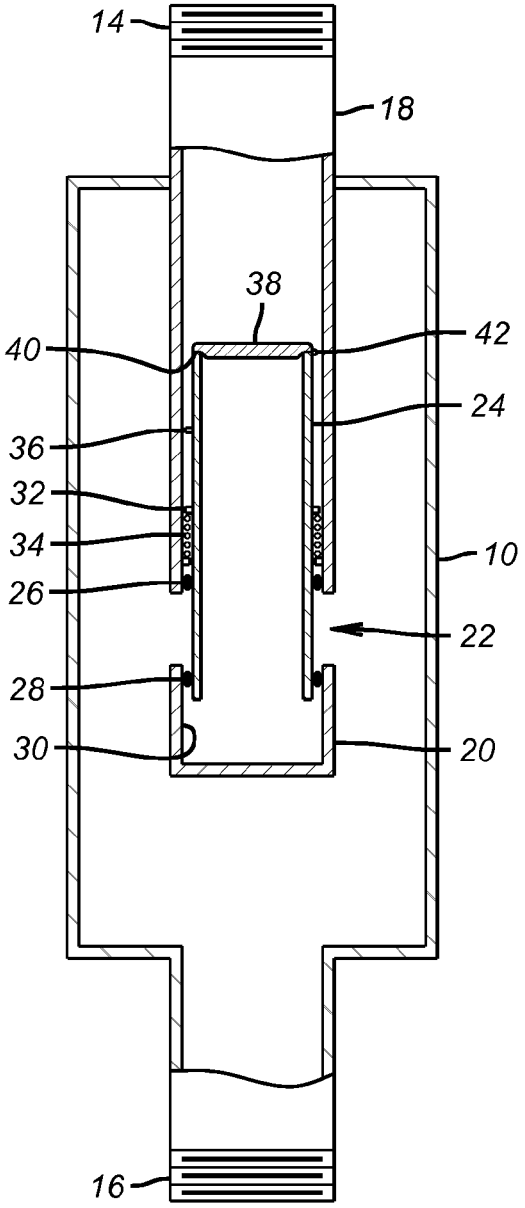
FIG. 1 is a schematic view of the valve of the present invention in the closed position.

FIG. 1 is a schematic representation of the valve of the present invention. It features a housing 10 that has end connections 14 and 16 to connect the housing 10 to a production string that is not shown. Connection 14 leads to a tube 18 that has a closed bottom 20 and one or more wall ports 22 above the bottom 20. There is a pressure relieving device (not shown), such as a poppet valve or a spring operated ball check valve that will allow flow from the inside of bottom 20 to the outside of bottom 20, so that when the valve is closed and pressure is applied that will cause the sleeve 24 to move down, fluid will be able to escape through that pressure relieving device so that the sleeve would not be hydraulically locked. Below connection 16 there can be a packer, a screen, or other form of well completion. Formation flow comes in to the inlet connection 16 and reaches the surface through a second connection 14. Sleeve 24 is cycled with applied pressure down the production tubing, through connection 14 onto the top of a flapper 38 that the pressure forces down onto seat 40, as will be fully described below.

Inside of tube 18 is a sleeve 24. Seals 26 and 28 can be either mounted to the inner wall 30 of tube 18 or they can be carried on the sleeve 24. In FIG. 1 the sleeve 24 is in the lower position across ports 22 and the seals 26 and 28 are in between and above and below ports 22 to effectively close them. Spring 34 bears on tab 32 that extends from sleeve 24 to create an upward bias on sleeve 24 when it is pushed down to compress spring 34. Sleeve 24 is movably mounted to the inside of tube 18 by a j-slot mechanism 36. Sleeve 24 is capable of reciprocating and rotating as a pin follows a continuous slot for the j-slot mechanism, in a known manner. The j-slot is configured so that after a predetermined number of cycles of pressure induced down movement and up movement induced by spring 34 when the applied pressure is removed, the pin of the j-slot mechanism can enter a longer channel so that the sleeve 24 can go from the position of FIG. 1 to the position of FIG. 2 and allow the ports 22 to go open.

The way the sleeve 24 is pushed down with pressure applied from connection 14 is that a flapper 38 sits on a seat 40 and is pivotally mounted to the sleeve 24 at pivot 42. The weight of the flapper 38, as well as a spring on its hinge, makes the flapper fall against the seat 40 when there is no flow through the housing 10 because the ports 22 are closed by sleeve 24, as shown in FIG. 1.

With the flapper 38 on its seat 40 pressure is applied to it from the surface through connection 14. The application of pressure forces the sleeve 24 down and compresses spring 34. Some leakage past the seat 40 can be tolerated as long as the applied force is high enough to overcome spring 34. Alternatively, it can be a complete seal to create a double closure. When pressure is removed the sleeve 24 can move up from the force of spring 34 while the j-slot mechanism 36 causes sleeve 24 to rotate on its axis as a pin follows a curved slot pattern. After enough cycles of pressurizing and removal of pressure onto flapper 38 a final release of pressure allows a pin to go into an elongated slot in the j-slot assembly 36 to allow the sleeve to rise to a higher elevation, shown in FIG. 2, which represents the open position for ports 22. In the FIG. 2 position, the well can be brought in as shown schematically by arrow 44. On the other hand, if for any reason the well does not flow from low reservoir pressure when the ports 22 are opened, the flapper will be forced by its hinge spring to close as fluid in the tube 18 and the production string above (not shown) will try to get out through openings 22 and that will cause the flapper 38 to pivot on pivot 42 against the seat 40.

Figure 2:
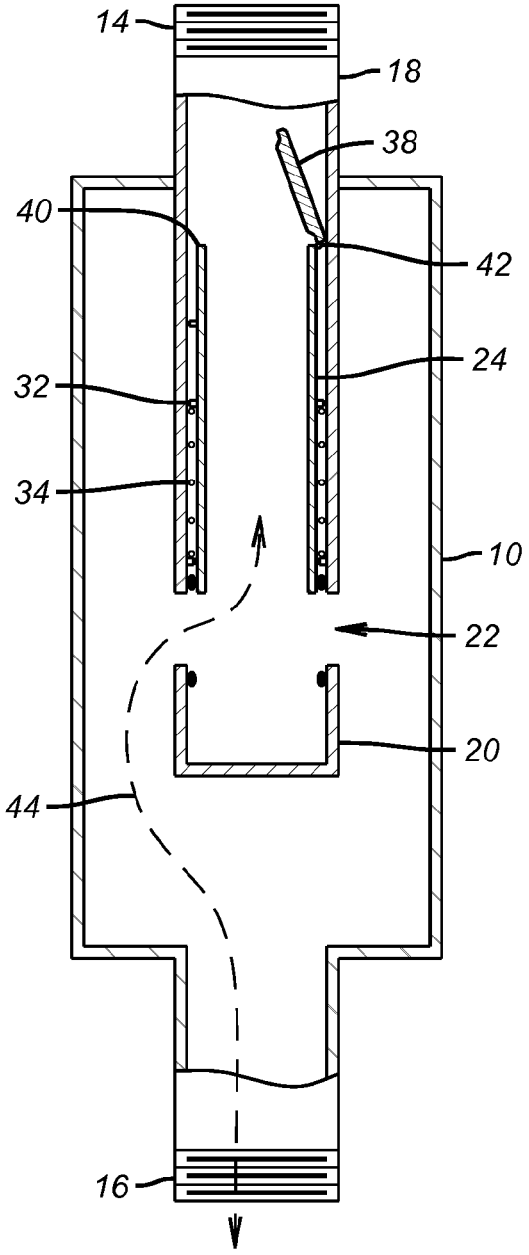
FIG. 2 is the view of FIG. 1 in the valve open position.

Those skilled in the art will appreciate that the embodiment shown in FIGS. 1 and 2 can be cycled to open and close ports 22 any number of times, which means that this valve can be installed once and then used to control production and/or fluid loss as many times as necessary. While the closure has been shown as a flapper 38 other types of closures can be substituted such as a ball valve that is actuated by movement of sleeve 24. The preferred embodiment works automatically to prevent fluid loss with ports 22 open but the present invention embodies a manual actuation of the fluid loss feature such as by operating a different valve type than the flapper 38. The j-slot can be optionally eliminated if a single cycle valve assembly is acceptable for a particular installation. In that variation the ports can be closed once, if initially open or vice versa.

Those skilled in the art will appreciate that the valve of the present invention allows for a temporary closure to allow pressurizing from uphole to get the valve into its needed position coupled with a feature that allows flow uphole while pushing aside the temporary barrier that allowed pressure operation of the valve from the surface. In the preferred embodiment the temporary barrier is a flapper that flow from the formation rotates to open leaving the flapper out of the flow path and giving a full bore opening for production or passage of other tools. Optionally, the flapper 38 can be locked open or closed with ports 22 either open or closed, all depending on what the desired final position of the ports 22 is desired.

Other variations include a removeable sleeve and flapper (by wireline, coiled tubing or tubing means) that would allow these parts to be taken to surface and repaired/replaced as needed, and also the use of a wireline profile nipple and plug at position 20. With the sleeve and flapper removed, the plug in the bottom of 20 could then be removed to allow workover of the well by passing tools completely through the valve.

The above description is illustrative of the preferred embodiment and many modifications may be made by those skilled in the art without departing from the invention whose scope is to be determined from the literal and equivalent scope of the claims below.

We claim:

1. A valve for downhole use in a tubular string, comprising:

a housing having a flow path therethrough and a first and second connection to said flow path, said first and second connections adapted for connection to the tubular string and represent the only exit or entrance from said flow path to an outside of said housing, said flowpath having at least one lateral exit within said housing;

a tubular shaped valve member defining a valve passage that is aligned with said flow path, said valve passage selectively closed by a valve closure secured to said valve member, said valve member having a first position where one way flow is only possible in said flow path through said lateral exit when said lateral exit is unobstructed by said valve member, said one way flow displacing said valve closure and a second position where said flow path is closed by said valve member obstructing said lateral exit of said flowpath, said valve member moving between said first and second position in response to pressure delivered into said housing through one of its said connections from the tubular string.

2. The valve of claim 1, wherein:

said valve member is movable responsive to fluid pressure delivered through said first connection when said passage is substantially closed, said first connection located uphole from said second connection.

3. The valve of claim 2, wherein:

said valve member is movable responsive to cycling on and off of fluid pressure delivered through said first connection when said passage is closed.

4. The valve of claim 3, wherein:

said valve member is supported in said flow passage by a j-slot mechanism.

5. The valve of claim 4, wherein:

said valve member is biased toward said first connection.

6. The valve of claim 5, wherein:

said valve closure in said valve passage comprises a check valve.

7. The valve of claim 6, wherein:

said check valve comprises a flapper pivotally mounted to said valve member.

8. The valve of claim 7, wherein:

said valve member comprises a seat surrounding said passage.

9. The valve of claim 8, wherein:

the weight of said flapper and the spring on its hinge urges it to pivot toward said seat, closing the seat.

10. The valve of claim 9, wherein:

flow through said flow path from said first toward said second connection urges said flapper toward said seat.

11. The valve of claim 9, wherein:

said flapper falls to said seat in the absence of flow through said flow path.

12. The valve of claim 9, wherein:

the seal between said flapper and said seat is not fluid tight.

13. The valve of claim 1, wherein:

said valve closure in said valve passage comprises a check valve.

14. The valve of claim 13, wherein:

said check valve comprises a flapper pivotally mounted to said valve member.

15. The valve of claim 14, wherein:

said valve member comprises a seat surrounding said passage.

16. The valve of claim 15, wherein:

the weight of said flapper and its hinge spring urges it to pivot toward said seat.

17. The valve of claim 16, wherein:

flow through said flow path from said first toward said second connection urges said flapper toward said seat.

18. The valve of claim 16, wherein:

said flapper falls to said seat in the absence of flow through said flow path.

19. The valve of claim 16, wherein:

the seal between said flapper and said seat is not fluid tight.

20. The valve of claim 1, wherein:

said valve member is removably mounted to said housing for retrieval of said valve member from downhole.

21. The valve of claim 20, wherein:

said housing having a removable component so as to allow an unimpeded straight through flow path through said housing when said valve member is removed further facilitating deploying a wireline tool through said flow path.

* * * * *